United States Patent [19]

McNeer

[11] 4,071,376

[45] Jan. 31, 1978

[54] ULTRASONIC CLEANING WITH FLOATING TRANSDUCERS

[76] Inventor: Larry M. McNeer, 3 Green Fir Circle, Syracuse, N.Y. 13219

[21] Appl. No.: 690,000

[22] Filed: May 26, 1976

Related U.S. Application Data

[63] Continuation-in-part of Ser. No. 610,973, Sept. 8, 1975, abandoned.

[51] Int. Cl.[2] ..... B08B 3/12

[52] U.S. Cl. ..... 134/1; 134/22 R; 134/169 R; 134/186

[58] Field of Search ..... 134/1, 22 R, 34, 169 R, 134/184, 186; 259/DIG. 43, DIG. 44

[56] References Cited

U.S. PATENT DOCUMENTS

| | | | |
|---|---|---|---|
| 2,437,456 | 3/1948 | Bodine, Jr. | 134/1 UX |
| 2,644,472 | 7/1953 | Ward | 134/169 R X |
| 3,021,120 | 2/1962 | Van Der Burgt | 134/1 X |

FOREIGN PATENT DOCUMENTS

| | | | |
|---|---|---|---|
| 839,402 | 6/1960 | United Kingdom | 134/1 |

*Primary Examiner*—S. Leon Bashore
*Assistant Examiner*—Richard V. Fisher
*Attorney, Agent, or Firm*—Charles S. McGuire

[57] ABSTRACT

A method of cleaning a surface by means of ultrasonic waves propagated through a liquid medium, having particular utility in the decontamination of the external or internal surfaces of nuclear fuel casks. For external surface cleaning, a hollow cylinder, open at both ends, is placed over the cask and sealed to the base plate. A buoyant ring, to which ultrasonic transducers are attached, is placed within the cylinder, encircling the cask. The cylinder is then filled with a cleaning solution and the ring floats from the bottom to the top of the cask as power is supplied to the transducers to produce cavitation of the solution. The cylinder is then drained and the ultrasonic cleaning is preferably continued as the ring is lowered with the level of the solution.

10 Claims, 4 Drawing Figures

ULTRASONIC CLEANING WITH FLOATING TRANSDUCERS

REFERENCE TO RELATED APPLICATION

The present application is a continuation-in-part of U.S. application Ser. No. 610,973, filed Sept. 8, 1975, of the same inventor, now abandoned.

BACKGROUND OF THE INVENTION

The present invention relates to cleaning methods and, more particularly, to a method utilizing ultrasonic means to effect cleaning and decontamination of the external or internal surfaces of nuclear fuel casks.

The shipping casks for radioactive materials in nuclear generating plants must be decontaminated to an acceptable level before leaving the plant. Currently, the external surfaces of spent fuel casks are cleaned either by high velocity water jets or by manual scrubbing. Both methods require long time periods for adequate cleaning. Typically, three or four days of continuous cleaning are required in order to bring the radiation down to acceptable levels for shipment. Moreover, large amounts of radioactivity are released to the atmosphere by water jet cleaning, and workers may receive large radiation doses when cleaning the casks manually. The internal surfaces of the casks are usually steam cleaned and, while being generally smooth and presenting less cleaning problems than the external surfaces, involve considerable time and expense in reaching acceptable levels of radioactivity.

It is apparent, therefore, that the economic disadvantage associated with extended cleaning periods, together with the radiation hazards, render present cleaning methods undesirable. The present invention has a principal object the provision of a method for cleaning nuclear fuel shipping casks which is much faster than presently used methods, as well as safe and effective.

A further object is to provide a novel cleaning method of general application utilizing ultrasonic means.

Other objects will in part be obvious and will in part appear hereinafter.

SUMMARY OF THE INVENTION

In accordance with the foregoing object, the cleaning method of the invention utilizes ultrasonic transducers to produce cavitation in a fluid medium contacting the surface to be cleaned. As is well known, effective cleaning may be accomplished in this manner. The transducers are attached to a buoyant ring to form a substantially continuous array with the wave-emitting surfaces facing the internal or external surface to be cleaned. While the method is described in more detail as practised in the cleaning of external surfaces of nuclear fuel casks, it is apparent that it may be employed with equal facility in cleaning internal cylindrical surfaces, or even planar surfaces merely by positioning the transducers with their wave-emitting surfaces facing the surface to be cleaned.

In the described embodiment, a hollow cylinder, open at both ends, is lifted over the shipping cask and sealed to the base plate thereof by a rubber gasket. The buoyant ring is placed inside the cylinder, encircling the cask, with the transducers on the bottom of the ring. The cylinder is then filled with water containing a cleaning solution such as acetic acid in appropriate concentration. As the liquid level rises, the ring floats on the surface with the transducers submerged a short distance below the surface. Power is applied to cause the transducers to emit waves sufficient to produce cavitation of the fluid, thereby removing contaminants from the external surface of the cask.

When the cylinder has been filled to a sufficient level to bring the transducers at least even with the top of the cask, the cleaning fluid is drained from the cylinder. Power is applied to the transducers, whereby cleaning continues, as the fluid level descends, until the cylinder is empty and the transducers are at the lowest level of the cask surface. The cylinder and ring are then removed and the cask is ready for shipment.

DETAILED DESCRIPTION

Figure 1:
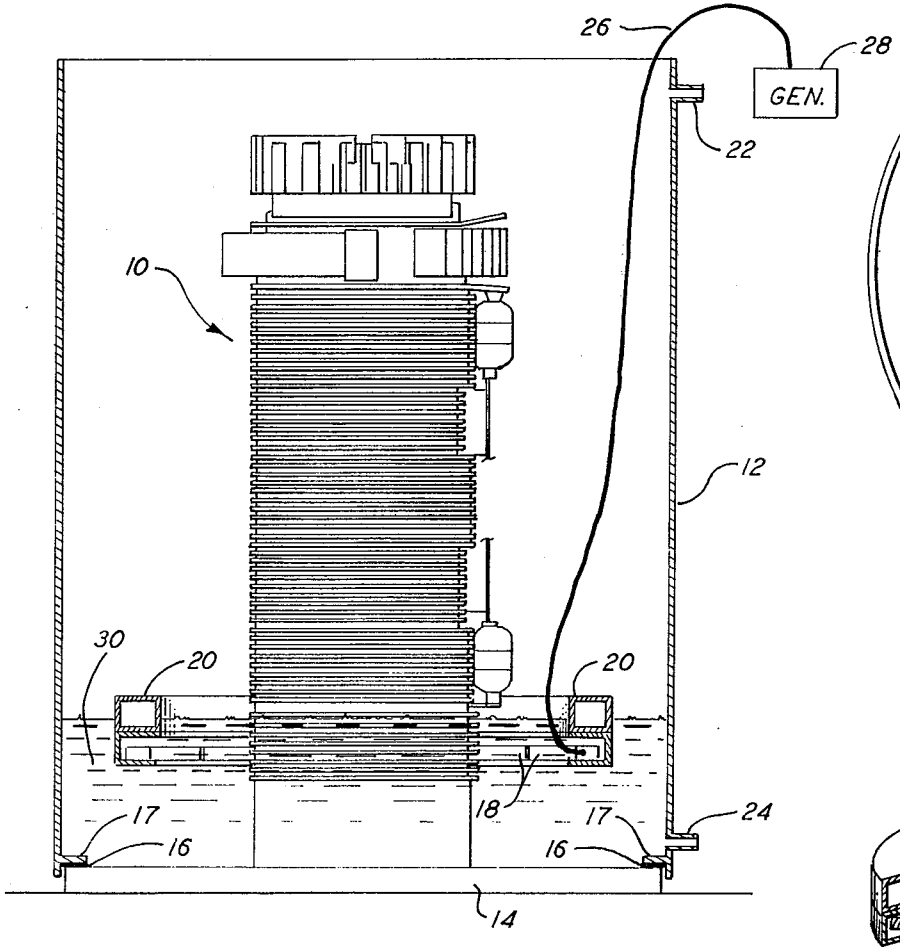
FIG. 1 is an elevational view of a typical nuclear fuel shipping cask, encircled by a hollow cylinder and buoyant ring, both of which are shown in section.

Although the cleaning method of the invention may be of general application, the major advantages associated therewith are particularly suited to cleaning and decontaminating nuclear fuel shipping casks. The casks in most common use at the present time are those manufactured by General Electric and designated by Model No. IF-300. The cask shown in FIG. 1 is of this type, and is generally denoted by reference numeral 10. The fins and recesses evident on the exterior of the cask make thorough cleaning by water yet or manual means extremely difficult and time consuming. Details of construction of the cask or, for that matter, of any object or surface to be cleaned by the method of the present invention, have no effect on the operation thereof.

Figure 2:
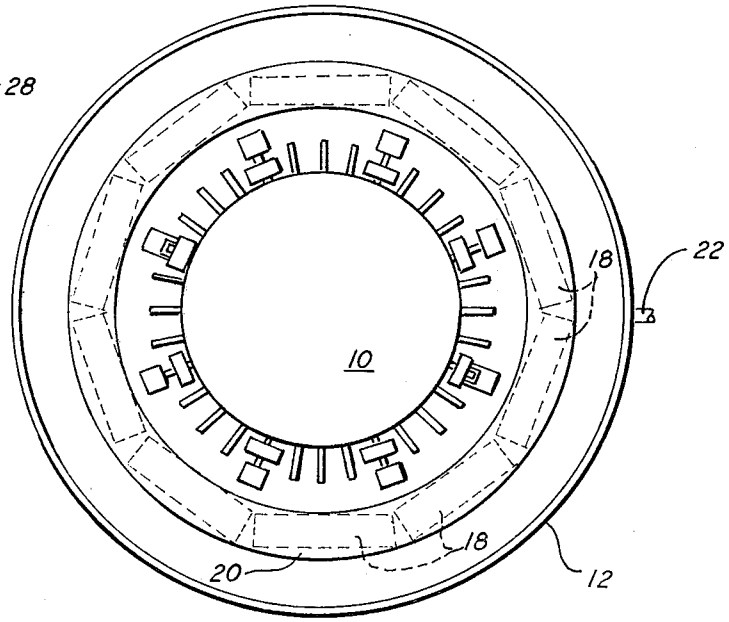
FIG. 2 is a full plan view of the apparatus shown in FIG. 1.
Figure 3:
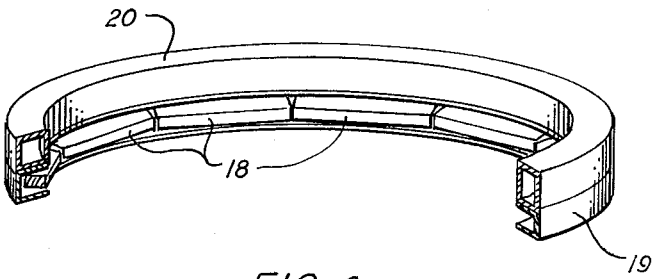
FIG. 3 is a fragmentary, perspective view of the buoyant ring with transducers attached.

Hollow cylinder 12, open at both ends, is hoisted over cask 10 and sealed to base plate 14 thereof by means of rubber gasket 16 upon which internal lip 17 of the cylinder rests. Cylinder 12 may be fabricated of $\frac{1}{4}$ inches stainless steel or, if desirable in some applications, of a suitable non-coducting material. The weight of the cylinder will normally provide the necessary degree of sealing, without the necessity of clamping or otherwise securing the cylinder in engagement with the gasket or base plate. A plurality of ultrasonic transducers 18 are arranged end to end in a continuous array and attached to hollow, sealed ring 20. The ring is fabricated of such materials and structure as to be buoyant in a liquid medium while supporting transducers 18. Mounting of transducers 18 may be facilitated by welding channel member 19 to the bottom surface of ring 20 and utilizing the mounting lugs provided on conventional transducers for attaching them to the channel member. Such an arrangement is illustrated more clearly in FIG. 3.

Cylinder 12 is provided with fill and drain lines 22 and 24, respectively. With cylinder 12 in place, ring 12 is placed around cask 10 with transducers 18 on the lower side. Cable 26 extends from a suitable ultrasonic generator diagrammatically indicated by block 28, to individual connections with each of the transducers in conventional fashion. The cylinder is filled with a liquid medium, identified in FIG. 1 by reference numeral 30, through line 22. As soon as the transducers are submerged, power is applied by generator 28 to pulse transducers 18. The latter are placed with their pulse-transmitting surfaces facing inwardly, i.e., toward cask 10.

As the liquid level rises, ring 20 floats on the surface. Since transducers 18 are carried on the lower side of the ring they will be submerged by a few inches. The power applied by the generator is at least equal to that required for the transducers to produce cavitation of the liquid since this is the mechanism by which ultrasonic cleaning is accomplished. This power level is dependent on a number of factors, such as the frequency of the transducers and the nature of the liquid medium. For example, if transducers 18 have a frequency of 40 kHz the power required to cavitate fresh tap water is 0.51 watts per square centimeter of surface. The power requirement for pure, degassed water at a frequency of 40 kHz is $5w/cm^2$.

The cylinder is filled to an extent sufficient to move transducers 18 from the lowest to the highest horizontal level of cask 10 while applying power. The rate at which cylinder 12 is filled is a function of the level of cleaning and decontamination required and the effectiveness of the liquid medium in accomplishing such cleaning when cavitated by the action of transducers 18. If water is used as the basic liquid its effectiveness may be enhanced by a detergent in solution. Acetic acid, for example, is an inexpensive and effective detergent, and is preferred in a concentration of about 15% for cleaning and decontaminating nuclear fuel shipping casks. There is a point at which the cleaning action is not materially affected by further increase in the concentration of detergent. For specific applications, the optimum type of liquid, and concentration and type of detergent therein may be determined empirically, or chosen from those known to be effective.

When transducers 18 reach the highest required level, filling is stopped and draining is commenced through line 24. Power continues to be applied, and thus the cleaning operation continues, during drawing. The drained liquid is discarded through a drain connected to the reactor facility capable of treating the radioactive liquid in known fashion. When draining is completed, transducers 18 will again be at the lowest level of cask 10, and the cleaning operation is completed. Cylinder 12 and ring 20 are then removed from around cask 10, and the latter is ready for shipment.

Although not essential to operation of the invention, it is preferred that transducers 18 are operated in an unmodulated mode since full or half wave pulsed systems would require a longer time to reach the same level of cleaning. As a further refinement, a switch responsive to the liquid level in the cylinder may be provided to insure that power is applied to the transducers only when they are submerged. Also, suitable guide means may be provided for cable 26 as ring 20 is raised and lowered to insure that there is no interference with free movement of the ring at the liquid surface.

From the foregoing description, it is apparent that the method may be practiced with equal facility in cleaning the internal surfaces of the casks. In this event, the water-tight chamber is provided by the cask itself and the position of the transducers is reversed to place the wave-emitting surfaces in an outwardly facing direction. A floatation ring and supporting structure for the transducers of appropriate size are provided, and the manner of operation is exactly analagous to the previously described embodiment.

Figure 4:
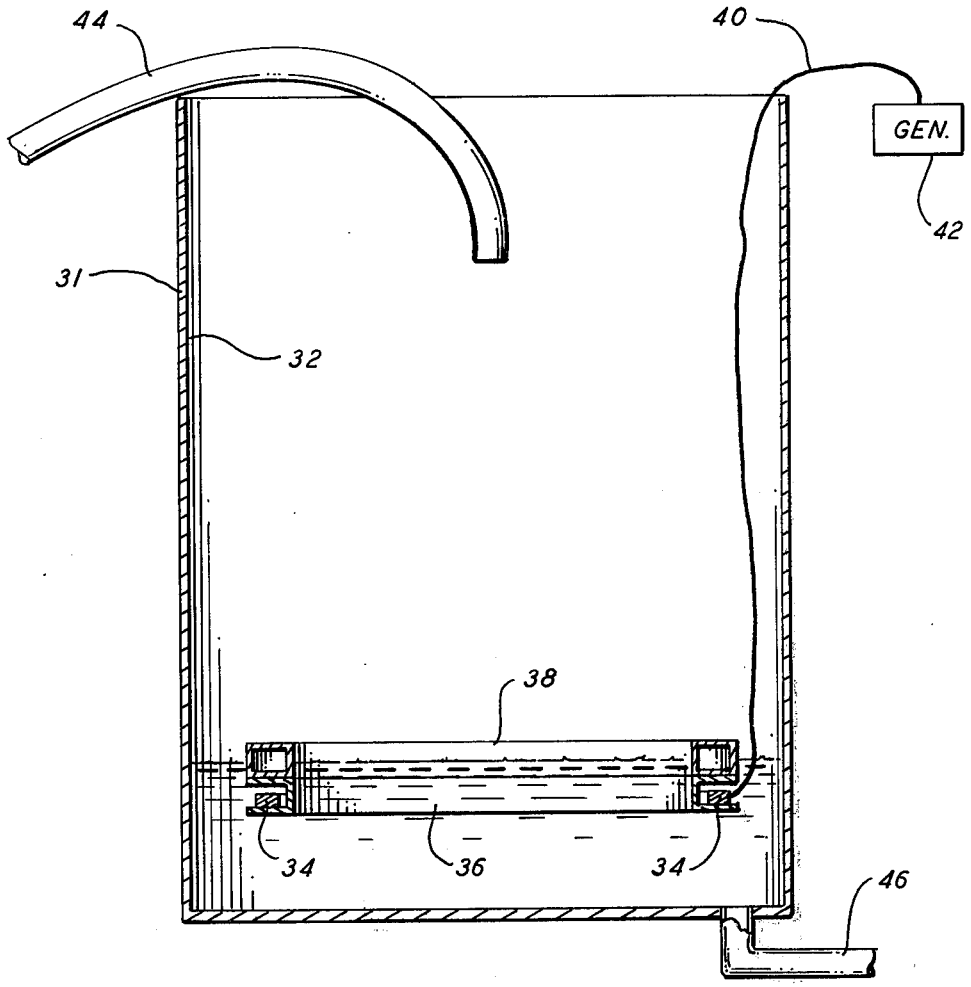
FIG. 4 is an elevational view, in section, illustrating employment of the invention in the cleaning of internal surfaces.

Such an arrangement is illustrated in FIG. 4, wherein the fuel cask is represented by cylinder 31, internal surface 32 of which is to be cleaned. Transducers 34 are mounted in a substantially continuous array about annular channel member 36 which is affixed to the lower surface of floatation ring 38. Cable 40 provides electrical connection between pulse generator 42 and transducers 34, the wave-emitting surfaces of which are directed outwardly toward surface 32.

Cylinder 31 is initially emptied of any contents and ring 38, with member 36 and transducers 34 attached thereto as shown, is placed on the bottom. Water or other cleaning solution is added through hose 44. Appropriate structure (not shown) may be provided for holding the portion of hose 44 inside cylinder 31 out of the path of ring 38 as liquid is added and drained during the cleaning operation. If the cylinder, or other object having the internal surface being cleaned, is normally provided with an appropriately valved drain conduit 46, as are conventional nuclear fuel casks, the cleaning solution may be drained therethrough. Alternatively, the liquid may be pumped or siphoned out through hose 44, or another hose extending to the bottom of the cylinder.

What is claimed is:

1. A method of cleaning a surface comprising:

a. forming an enclosed, substantially liquid-tight chamber within which the surface to be cleaned is fully exposed;

b. attaching at least one ultrasonic transducer to floatation means capable of supporting said transducer in a liquid medium;

c. positioning said floatation means and transducer within said chamber at a vertical level at least as low as the lowest point on, and with the wave-emitting surface of said transducers facing toward said surface to be cleaned;

d. filling said chamber with a liquid medium from the lowest to the highest point to be cleaned on said surface, whereby said floatation means and transducer float from said lowest to said highest point;

e. applying power to said transducer during said filling sufficient to cause cavitation of said liquid medium, thereby cleaning said surface; and f. draining said liquid medium from said chamber.

2. The invention according to claim 1 and further including the step of applying power to said transducer as said liquid medium is drained.

3. The invention according to claim 1 wherein the surface to be cleaned is an external surface of an object and said chamber is formed by placing a hollow cylinder around said object.

4. The invention according to claim 3 wherein said floatation means is annular and encircles said object.

5. The invention according to claim 4 wherein a plurality of transducers are attached in a substantially continuous array around said floatation means.

6. The invention according to claim 5 wherein said transducers are mounted beneath said floatation means.

7. The invention according to claim 3 wherein said object is a nuclear fuel cask.

8. The invention according to claim 7 wherein said liquid medium is water containing a detergent in solution.

9. The invention according to claim 8 wherein said detergent is acetic acid.

10. The invention according to claim 1 wherein the surface to be cleaned is the internal surface of a cylinder which forms said chamber.

* * * * *